US009090954B2

(12) United States Patent
Tassios et al.

(10) Patent No.: US 9,090,954 B2
(45) Date of Patent: Jul. 28, 2015

(54) PRODUCTION PROCESS

(75) Inventors: Steven Tassios, Victoria (AU); Timothy Raymond Douglas Barton, Victoria (AU); Michael Wilson Nagle, Victoria (AU); Keri Koulla Constanti-Carey, Victoria (AU); Leon Hugh Prentice, Victoria (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 1156 days.

(21) Appl. No.: 13/054,009

(22) PCT Filed: Jul. 31, 2009

(86) PCT No.: PCT/AU2009/000980

§ 371 (c)(1),
(2), (4) Date: Apr. 6, 2011

(87) PCT Pub. No.: WO2010/012042

PCT Pub. Date: Feb. 4, 2010

(65) Prior Publication Data

US 2011/0179794 A1 Jul. 28, 2011

(30) Foreign Application Priority Data

Jul. 31, 2008 (AU) ..... 2008903933

(51) Int. Cl.

| | |
|---|---|
| ***F27D 11/00*** | (2006.01) |
| ***C22B 26/22*** | (2006.01) |
| ***C22B 4/02*** | (2006.01) |
| ***C22B 4/08*** | (2006.01) |
| ***C22B 5/10*** | (2006.01) |
| ***C22B 21/02*** | (2006.01) |

(52) U.S. Cl.
CPC . *C22B 26/22* (2013.01); *C22B 4/02* (2013.01); *C22B 4/08* (2013.01); *C22B 5/10* (2013.01); *C22B 21/02* (2013.01)

(58) Field of Classification Search
CPC ..... F27D 11/00; F27D 11/06
USPC ..... 266/216, 217, 265, 170
See application file for complete search history.

(56) References Cited

U.S. PATENT DOCUMENTS 4,147,534 A 4/1979 Hori
4,200,264 A 4/1980 Hori
6,155,815 A * 12/2000 Crandell ..... 425/549

FOREIGN PATENT DOCUMENTS

EP 0845645 B1 1/2003

OTHER PUBLICATIONS

International Search Report PCT/AU2009/000980 dated Sep. 8, 2009.

*Primary Examiner* — Scott Kastler
(74) *Attorney, Agent, or Firm* — Foley & Lardner LLP

(57) ABSTRACT

A process for the production of a metal which comprises: carbothermal reduction of the corresponding metal oxide to produce a mixed gas stream comprising the metal and carbon monoxide; maintaining the mixed gas stream at a suitably elevated temperature to prevent reformation of the metal oxide; ejecting the mixed gas stream through a convergent-divergent nozzle in order to cool the mixed gas stream instantaneously to a temperature at which reformation of the metal oxide cannot take place; and separating and collecting the metal, wherein the nozzle is heated by means other than gas flow through the nozzle so that temperature of surfaces of the nozzle in contact with the mixed gas stream are maintained at a temperature sufficient to prevent deposition on the said surfaces of products from the gas stream.

6 Claims, 6 Drawing Sheets

PRODUCTION PROCESS

The present invention relates to a process for the production of metals by carbothermal reduction of corresponding metal oxides and to an apparatus (reactor) suitable for implementation of the process.

The present invention is believed to have particular utility in the production of magnesium from magnesia, and the invention will be described with particular reference to the production of magnesium. However, the principles underlying the present invention are believed to have applicability to the production of a wider range of metals and so the present invention and disclosure thereof should not be regarded as being limited to the production of magnesium. By way of example, the invention may also be implemented to produce by carbothermal reduction manganese, calcium, silicon, beryllium, aluminium, barium, strontium, iron, lithium, sodium, potassium, zinc, rubidium, and caesium.

BACKGROUND TO THE INVENTION

The production of magnesium metal from its oxide by carbothermal reduction has been well-known for nearly a century. Fundamental to the process is the rapid quenching of the reaction products (carbon monoxide and magnesium vapour) to a temperature below that at which the reversion reaction takes place (about 400° C.). One way that has been proposed to achieve the requisite quenching has been to eject the product gases through a convergent-divergent nozzle at supersonic speed. This results in rapid expansion of the gases and instantaneous cooling as required (estimated to be at a rate of up to $10^{5\circ}$ C.s$^{-1}$). Examples of this approach include the disclosures of Hori (U.S. Pat. No. 4,147,534 and U.S. Pat. No. 4,200,264). In order to avoid the reversion reaction Hori teaches that thermal control of the product gases is important throughout the process from the reaction chamber to the product collection point via the nozzle.

Notwithstanding the general approach recommended by Hori, it has been found that solids tend to be deposited and accumulate on internal surfaces of the nozzle that are in contact with the gaseous products flowing through the nozzle. This can lead to deterioration in the performance of the nozzle and, even worse, blocking. Blocking results in potentially unsafe operating conditions (due to creation of over-pressure) and it then becomes necessary to shut down production and re-bore or replace the nozzle. The disclosures of Hori do not report blocking, and the reasons for this are not entirely clear. It may be because the processes were operated only on a small scale and/or with relatively pure reactants (impurities can add to the blocking problem). Interestingly, a methodology such as that proposed by Hori has not been implemented on a commercial scale.

It is also relevant to mention the disclosure by Donaldson, A and Cordes, R A, *Rapid Plasma Quenching for the Production of Ultrafine Metal and Ceramic Powders*, JOM, 2005:57 (4), pp. 58-63. This describes pre-heating of a quench nozzle in the experimental production of aluminium from a plasma reactor. Pre-heating takes place on start-up by feeding hot argon from the reaction furnace through the nozzle. Under sonic conditions, such heating would at best result in the nozzle surfaces reaching a temperature at equilibrium with the gas stream travelling through it. The present inventors have found that pre-heating the nozzle using a gas stream, as per Donaldson and Cordes, may be insufficient to produce and maintain the required temperature to avoid deposition problems, especially in the production of metals other than aluminum, for instance magnesium.

Further, Donaldson and Cordes mention pre-heating of the nozzle on start up only. Presumably, thereafter the temperature of the exit gas from the reaction furnace is relied upon to maintain nozzle temperature. However, the present inventors have found that this is not a reliable way to proceed to avoid deposition problems.

Against this background, it would be desirable to provide a process and reactor that enables the carbothermal reduction process described to be implemented on a commercial scale and that enables deposition problems to be alleviated and preferably avoided altogether for production of a range of metals, especially magnesium.

SUMMARY OF INVENTION

Accordingly, the present invention provides a process for the production of a metal which comprises:

- carbothermal reduction of the corresponding metal oxide to produce a mixed gas stream comprising the metal and carbon monoxide;
- maintaining the mixed gas stream at a suitably elevated temperature to prevent reformation of the metal oxide;
- ejecting the mixed gas stream through a convergent-divergent nozzle in order to cool the mixed gas stream instantaneously to a temperature at which reformation of the metal oxide cannot take place; and
- separating and collecting the metal,
- wherein the nozzle is heated by means other than gas flow through the nozzle so that the temperature of surfaces of the nozzle in contact with the mixed gas stream are maintained at a temperature sufficient to prevent deposition on the said surfaces of products from the gas stream.

An important aspect of the present invention involves the manner in which the nozzle is heated. Thus, in accordance with the present invention heating of the nozzle occurs by means other than gas flow through the nozzle. In other words, in the present invention heat is supplied to the nozzle over-and-above any heat that is supplied to the nozzle by gas flow. As will be explained, such heating (i.e. in addition to any heating due to gas flow) may be achieved by direct thermal coupling of a suitably conductive nozzle with the an upstream and associated carbothermal reactor (for example, with the induction field of the reactor, by the use of an inductive heating system, by direct heat transfer such as direct firing, and the like. Combinations of heating methodology may be employed.

It should also be noted that the approach adopted in the present invention (of maintaining the nozzle temperature at a suitably high temperature to avoid deposition) actually represents a surprising departure from conventional thinking since expansion of product gases through the nozzle is widely regarded as taking place adiabatically, i.e. the nozzle temperature is not affected. That being the case (and providing the gas stream into the nozzle was at a temperature above the temperature of the reversion reaction) blocking is not expected to take place and, moreover, additional heating of the nozzle would not be expected to have any practical affect on the blocking/deposition problem. Howev er, contrary to this thinking, the present inventors have now found that the temperature of the nozzle can vary (decrease) along its length from inlet to exit during operation of the process. The effect of this is that the nozzle can cause excessive cooling of the gas stream and this cooling can lead to condensation and deposition on (internal surfaces of) the nozzle of species present in the gas stream. Thus, the present inventors now propose that careful control of the nozzle temperature is highly relevant for reliable operation of the nozzle. This has been further confirmed by computational fluid dynamics studies of the nozzle operation, which indicate a very significant temperature gradient across the gas stream. This effect has also been verified by experimental work.

When gas flow through the nozzle is used to impart heat to the nozzle, in principle the maximum temperature that can be achieved for the nozzle will be the equilibrium temperature of the gas itself (assuming the nozzle is perfectly insulated and does not lose heat). However, as noted above, the nozzle temperature has unexpectedly been found to be lower than the equilibrium gas temperature, and this can lead to deposition problems. Moreover, the gas temperature itself may not be sufficient to avoid deposition. Heating of the nozzle in accordance with the present invention avoids these problems and enables the nozzle temperature to be maintained at any suitable temperature to avoid deposition independent of the temperature of gas flowing through the nozzle. This is a significant benefit when compared with the kind of approach adopted by Donaldson and Cordes, as noted above.

Heating of the nozzle as per the present invention might be expected to reduce the overall quenching efficiency of the nozzle and so increase likelihood of reversion reactions taking place. However, surprisingly this has not been found to be the case and the performance of the nozzle with respect to rapidity of quenching has been found to be unaffected.

BRIEF DISCUSSION OF FIGURES

Embodiments of the present invention are illustrated in the accompanying non-limiting drawings in which.

DETAILED DISCUSSION OF INVENTION

There are believed to be a number of mechanisms by which deposits are formed on the relevant surfaces of the nozzle. The first is relevant to start-up of the process and the corresponding conditions that exist at start-up. The remainder relate to steady-state operation of the carbothermal process. In an embodiment of the invention heating of the nozzle may be required during start-up as well as during steady-state operation. On start-up hot inert gas may be flushed through the nozzle and additional heat supplied as described herein. In an alternative embodiment on start-up the nozzle temperature is elevated by heating prior to any gas being allowed to flow through the nozzle. This is done to prevent deposition prior to establishment of steady-state operating conditions (temperature).

Figure 1:
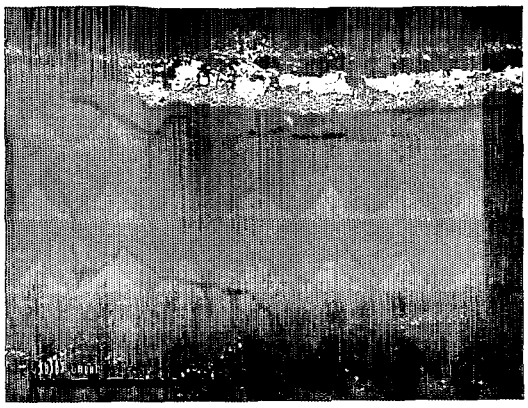
FIG. 1 is a backscattered SEM (Scanning Electron Microscope) image of a blockage cross-section, the scale of which applies also to FIGS. 2-6.

FIG. 1 is a back-scattered SEM (Scanning Electron Microscope) image of a blockage cross-section, with the graphite nozzle wall visible at the top. Adjacent to the wall may be observed a bright deposit, which is primarily calcium, iron, and silicon (see FIGS. 2-4). These species deposit during the start-up of the process.

The remaining blockage is primarily magnesium (FIG. 5), present as the oxide (FIG. 6), which has deposited progressively during steady-state operation of the nozzle.

Figure 2:
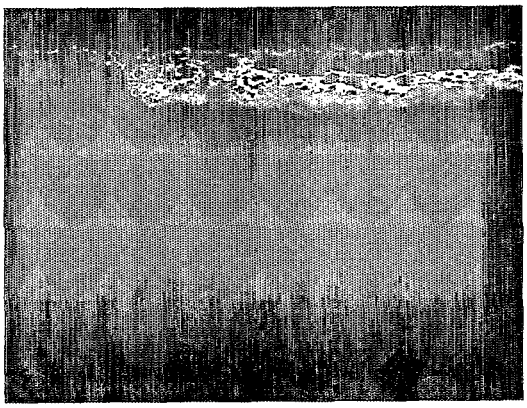
FIG. 2 is a Calcium (Ca) element map in nozzle blockage (in this and images 3-6, lightness indicates concentration of element mapped)
Figure 3:
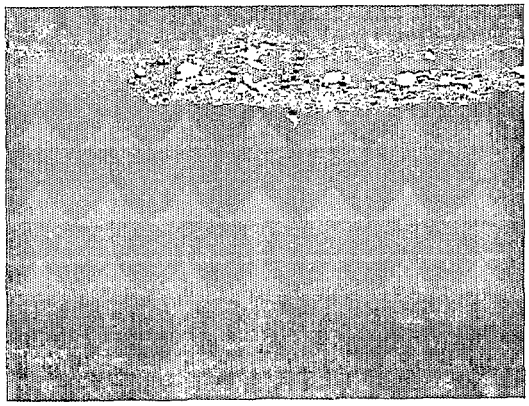
FIG. 3 is an Iron (Fe) element map in nozzle blockage.
Figure 4:
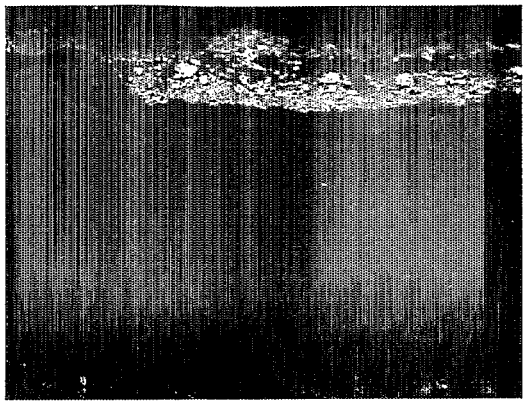
FIG. 4 is a Silicon (Si) element map in nozzle blockage.

Initially, and at relatively low temperatures, certain impurities in the starting materials (metal oxide), such as Ca, Fe, and Si in the case of reducing magnesium oxide, will be capable of being carbothermally reduced. Reduction of such oxides, of which the above list is by means of example, takes place at a temperature in the range 500 to 1000° C., well below the temperature at which the magnesium oxide can be reduced. At this time the nozzle is coming up to its intended operating temperature and is thus undercooled. Metallic vapours of the impurities will condense in the nozzle, leading to the commencement of the blockage process (FIGS. 2-4).

In accordance with an embodiment of the present invention the nozzle is heated so that at this critical time condensation of metallic vapours is avoided. In this embodiment the nozzle temperature may be elevated as necessary prior to any gases being ejected through it from the carbothermal reactor provided upstream of the nozzle so that when gases do flow through the nozzle it is already above the temperature at which condensation of species can occur. The critical temperature in this regard will depend upon the composition of the starting material and this can be determined based on such composition. When the nozzle temperature is elevated as required, gases from the upstream reactor can be allowed to pass through the nozzle without fear of deposition of solids in the nozzle. Typically, the temperature of the (relevant surfaces of the) nozzle are maintained above 1100° C., for example above 1300° C.

In this embodiment heating of the nozzle may be accomplished by any suitable means, including resistance heating, induction heating, direct external convection heating, or any other means appropriate to the materials and construction of the nozzle.

Figure 5:
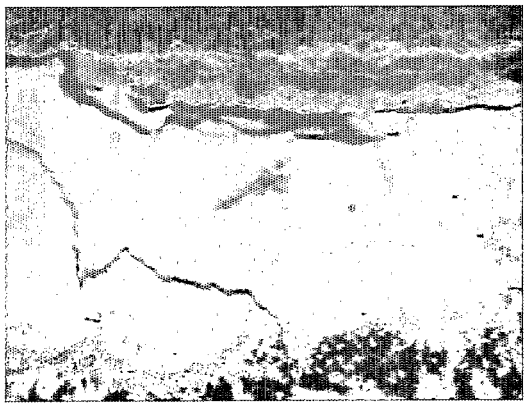
FIG. 5 is a Magnesium (Mg) element map in nozzle blockage.
Figure 6:
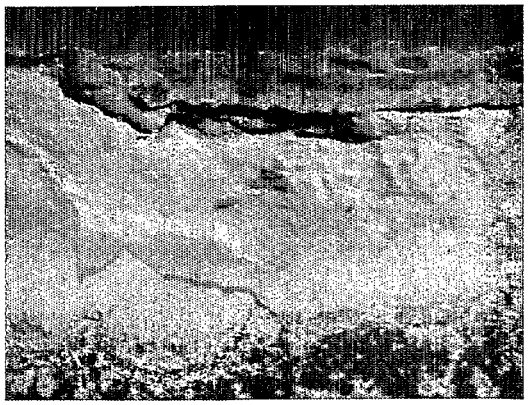
FIG. 6 is an Oxygen (O) element map in nozzle blockage.

At temperatures above 1700° C. magnesium and CO vapour are produced, along with impurities such as Al, Mn, and S that may be produced as a result of reduction of corresponding oxides at such high temperatures. If the temperature of the relevant surfaces of the nozzle is below the condensation temperature of any of these species, condensation will occur and deposits will form in the nozzle (FIGS. 5 and 6).

Furthermore, the reversion oxide products, such as CaO, $SiO_2$, MgO, and C, are stable at high temperatures and cannot be dislodged once formed in the nozzle. Thus, the temperature of the nozzle must be maintained above the critical reversion temperatures for these species, and any others that are likely to deposit under such temperature conditions.

Figure 7:
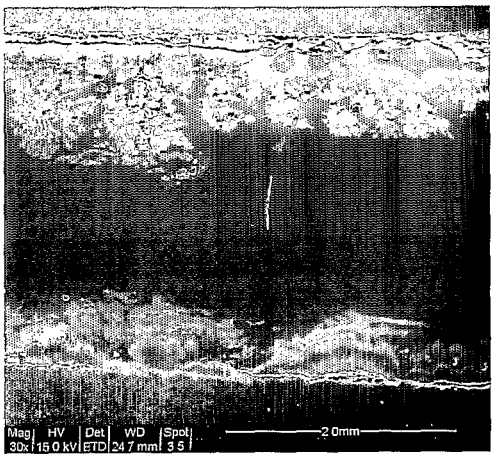
FIG. 7 is a backscattered SEM of nozzle cross-section, showing growth of blockage and irreversible choking of flow.

The formation of deposits in the nozzle is very important since even small amounts of deposits can interrupt gas flow through the nozzle, expanding the boundary layer and causing turbulence and increased reversion, the solid products of which contribute to further deposition and possibly blockage. FIG. 7 illustrates the progressive and catastrophic blockage resulting from this process.

Figure 8:
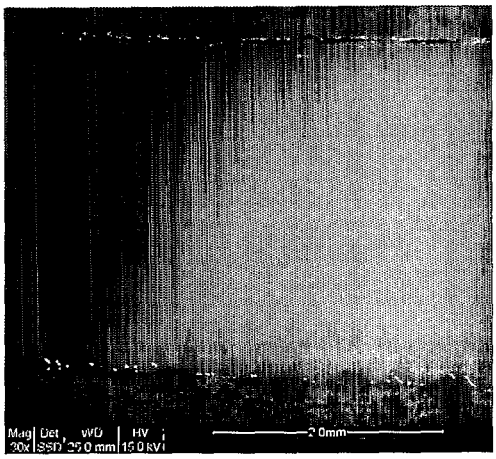
FIG. 8 is a backscattered SEM of nozzle cross-section after operation with additional heating, showing negligible blockage.

In accordance with the present invention it has been found that maintaining the nozzle surface temperature above the critical condensation temperatures for any, and all, gaseous species flowing through the nozzle is essential to reliable operation of the convergent-divergent nozzle (FIG. 8). Thus, the minimum temperature of surfaces of the nozzle that come into contact with gases flowing through the nozzle should always be sufficient to avoid condensation of species present in the gas at any point in time.

The present invention may be implemented using the same basic methodology and componentry/reactor as disclosed in Hori acknowledged above. However, a fundamental distinction over such conventional approaches is that in accordance with the present invention specific steps are taken to heat the nozzle to, and maintain the nozzle at, a suitable high temperature. In this context the invention relies on heating of the nozzle over-and-above any heating effect due to gas flowing through the nozzle. Such an approach would not be required if the nozzle operated adiabatically when hot gas flows through it. However, the present inventors have found this not to be the case so that "passive" heating of the nozzle by gas flow alone will not avoid the formation of deposits in the nozzle.

In accordance with the present invention the temperature of the nozzle may be controlled as required by a number of different approaches. In one embodiment, and as noted above, the nozzle may be heated by suitable heating apparatus associated with the nozzle and specifically provided with that function in mind. For example, the nozzle may be heated by induction coils that are arranged around the nozzle.

Figure 9:
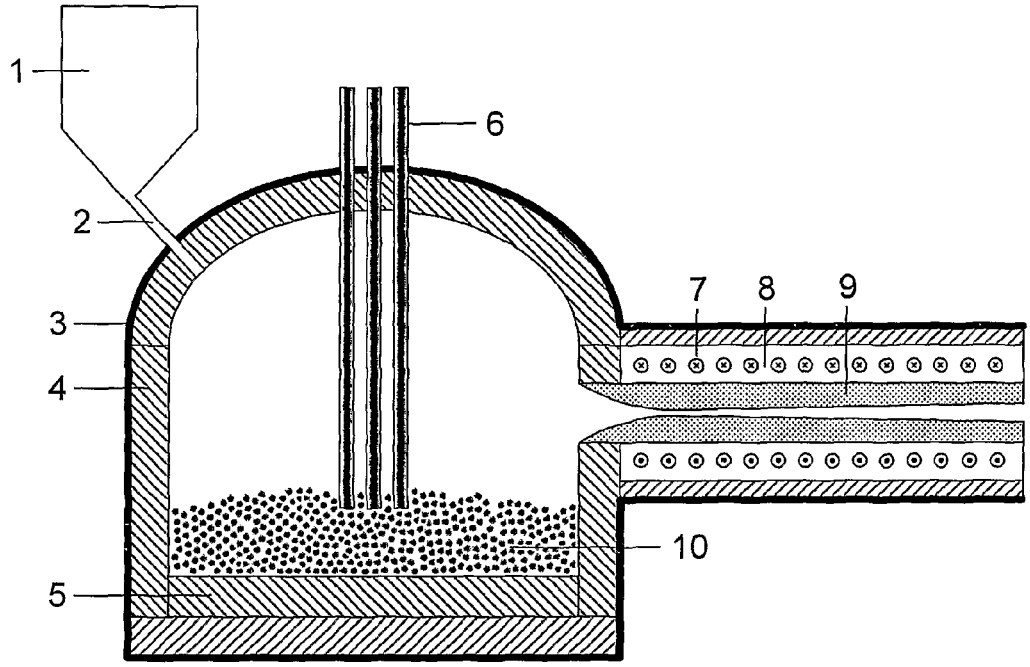
FIG. 9 is a schematic showing a reaction chamber and nozzle assembly, illustrating arc-furnace reaction chamber and specific induction heating apparatus for maintaining nozzle temperature.

In the embodiment illustrated in FIG. 9, pelletised reactants are fed from the hopper (1) via a feed tube (2) into the main reactor. The arc furnace is encased in a steel shell (3), lined with appropriate refractory (4) and hearth material (5). Electrodes (6) provide heating to the furnace. Induction coils (7), controlled independently of the furnace temperature, and encased in additional refractory (8), provide heating to the convergent-divergent nozzle (9) to prevent deposition and blocking. The level of reactants (10) is maintained at an appropriate level to optimise the reaction.

Figure 10:
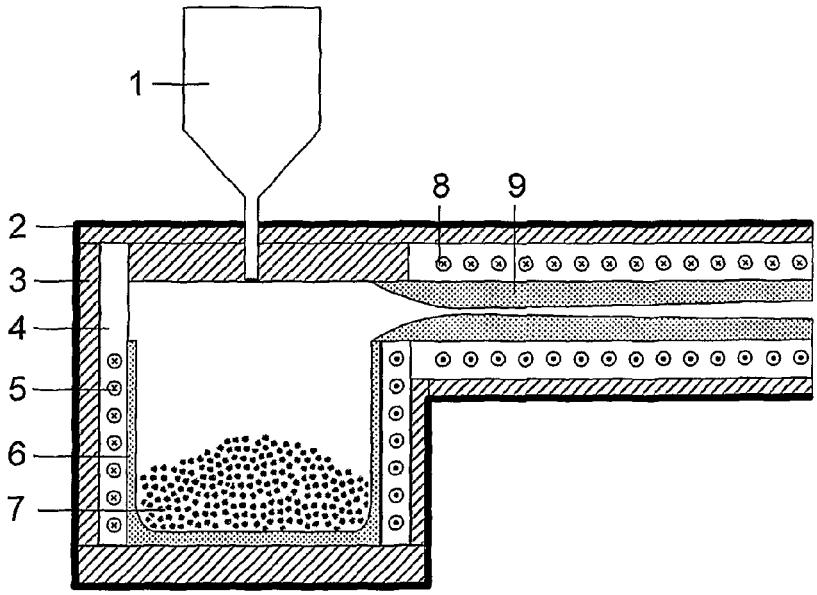
FIG. 10 is a schematic showing a reactor assembly and nozzle, illustrating induction heating of furnace and positioning of nozzle to achieve separate controlled induction heating of the nozzle surface.

In another embodiment however the nozzle may derive heat by being closely associated with the reactor in which the carbothermal reduction reaction takes place. In this case the nozzle derives heat by being located at least partially within the heated zone of the reactor. For example, the nozzle may derive heat from the primary induction coil of an inductively-heated reactor. In this embodiment heating of the nozzle may take place by one or more mechanisms: convective heating at medium temperatures and low gas flow rates (below 1000° C.); radiative heating (likely to be more prevalent at temperatures above 1000° C.; and heating due to coupling of the nozzle (usually graphite) with the induction field of the coil used to effect heating of the reactor, or with additional induction heating (see FIG. 10). In accordance with the present invention the position of the nozzle may be varied in order to derive the most beneficial heating effect given the intended outcome of the present invention. It may also be appropriate to insulate the nozzle in order to minimise heat loss. In the embodiment illustrated in FIG. 10, pelletised reactants are fed from the hopper (1) into the main reactor. The induction furnace is encased in a steel shell (2), lined with appropriate refractory (3), additional insulation (4) for the induction coil (5), and an appropriate conductive material (6), wherein the reactants (7) are maintained at an appropriate level. Additional induction coils (8) provide heating to the convergent-divergent nozzle (9).

In practice one or more of the approaches described for heating of the nozzle may be applied to achieve the most effective and economic result in the context of the present invention. The requisite temperature profile for the nozzle may be predetermined based on the composition of the starting material(s) to be reduced and on the gaseous species that will be flowing through the nozzle at any point in time. The input temperature of gas flowing through the nozzle may contribute to heating of the nozzle but, as has been noted, the gas temperature will not be determinative of the nozzle temperature since gas flow of the nozzle can cause cooling thereof.

In accordance with the invention the metal to be produced may be selected from the group consisting of Mg, Mn, Ca, Si, Be, Al, Ba, Sr, Fe, Li, Na, K, Zn, Rb and Cs.

The present invention may be particularly useful for the production of magnesium, and here it should be noted that the thermochemistry of metals can vary considerably. This point can be illustrated by considering aluminium and magnesium. Importantly, the reaction products from the carbothermal reduction of alumina have relatively high boiling points (aluminium boils at about 2500° C. and $Al_2O$ (aluminium sub-oxide) has an appreciable vapour pressure above about 1800° C.) when compared with the reaction products from the carbothermal reduction of magnesia (magnesium boils at about 1050° C. and no sub-oxide species exist). Accordingly, using conventional nozzle methodology, in which the nozzle is heated by gas flow, alumina-derived reaction products require higher nozzle temperatures in order to avoid deposition problems. Under the prevailing nozzle temperature attributable to gas flow (about 1100° C. on average assuming no losses), alumina-derived reaction products tend to readily condense and form deposits on the nozzle. In contrast during the carbothermal reduction of magnesia conventional thinking would lead to the expectation that the nozzle temperature would be suitably high so that the deposition problem would be unlikely to occur. However, the present inventors have found the opposite and this is somewhat unexpected given conventional wisdom in the art.

The reductant used in the present invention may be derived from a variety of conventional carbon sources including graphite, petroleum and coke (such as metallurgical coke).

The present invention also provides a reactor suitable for implementation of the process of the invention as described herein. The reactor design and construction is essentially the same as described in Hori acknowledged herein. However, the reactor of the present invention is adapted to achieve active heating of the nozzle (i.e. other than by gas flow) in order to avoid deposition problems. As described, the nozzle may be heated by heating means associated specifically with the nozzle (FIG. 10) and/or the nozzle may be positioned to derive heat from the reactor in which the carbothermal reduction reaction will take place (see FIG. 11).

Figure 11:
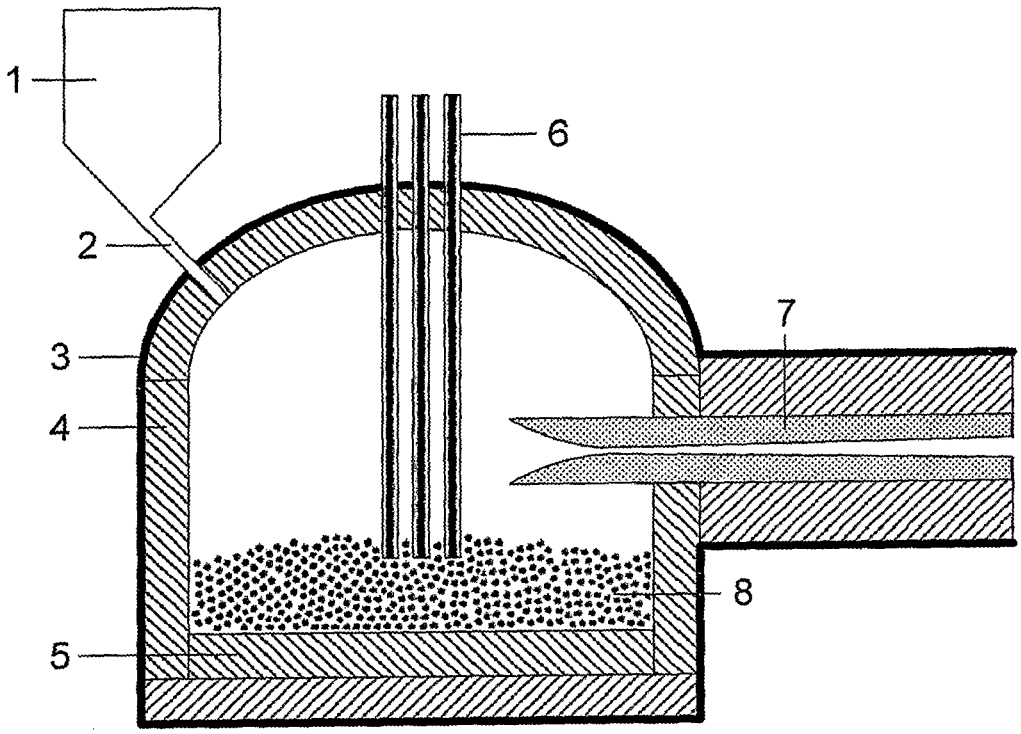
FIG. 11 is a schematic showing a reactor assembly and nozzle, illustrating position of the nozzle mostly within the reaction chamber in order to maintain surface temperature.

In the embodiment illustrated in FIG. 11, pelletised reactants are fed from the hopper (1) via a feed tube (2) into the main reactor. The arc furnace is encased in a steel shell (3), lined with appropriate refractory (4) and hearth material (5). Electrodes (6) provide heating to the furnace. In this case radiative and convective heating maintains an appropriate temperature of the convergent-divergent nozzle (7). The level of reactants (8) is maintained at an appropriate level to optimise the reaction.

In accordance with the present invention the temperature of the nozzle may be determined as the production process proceeds with the nozzle temperature being controlled as required to avoid deposition problems. The nozzle temperature may be measured using conventional methodology and apparatus. Alternatively, the temperature characteristics of the nozzle may be determined experimentally based on gas flow through the nozzle at varying temperatures with the nozzle temperature being adjusted in practice based on such determination, and supported by additional modelling. The latter approach would avoid the need to actively measure the nozzle temperature during the course of the production process.

The present invention is illustrated with reference to the following non-limiting example.

EXAMPLE

The two main series of experiments conducted were from TMG-84 to TMG-90 and TMG-91 to TMG-95. The first series had no additional heating of the nozzle surface, except for TMG-87, which is included here within the second series. Experiments TMG-91 to TMG-95, and TMG-87, included additional heating of the nozzle. The following summarises the results obtained.

a. TMG-84. No additional heating of the nozzle. Blockage occurred early and irreversibly; reaction terminated.
b. TMG-85. No additional heating of the nozzle. Blockage early and irreversible; no significant data obtained.
c. TMG-86. No additional heating. Nozzle blocked at a throat surface temperature around 1200° C.
d. TMG-87. Additional heating provided by nozzle position. Run proceeded to completion (300 g).
e. TMG-88. No additional heating provided. Experiment failed early.
f. TMG-89. No additional heating provided. Experiment failed early.
g. TMG-90. No additional heating provided, but reactor heated more slowly to allow some equilibration with nozzle. Insufficient temperature increase resulted in blockage.
h. TMG-91. Additional heating provided by nozzle location. Nozzle un-blocked above approximately 1650° C. 300 g charge consumed.
i. TMG-92. Repeat of TMG-91, with similar result.
j. TMG-93. Slightly faster heating resulted in a lower nozzle temperature and greater blockage during heat-up, but the blockage was similarly reversible above 1650° C. 400 g charge consumed.
k. TMG-94. Further additional heating provided by means of removal of internal insulation. (Heating now caused by induction coupling and radiation within reaction chamber.) Nozzle heated faster, resulting in a much flatter blockage profile (less blockage). 400 g charge consumed.
l. TMG-95. Repeat of TMG-94, with 500 g charge consumed.

Figure 12:
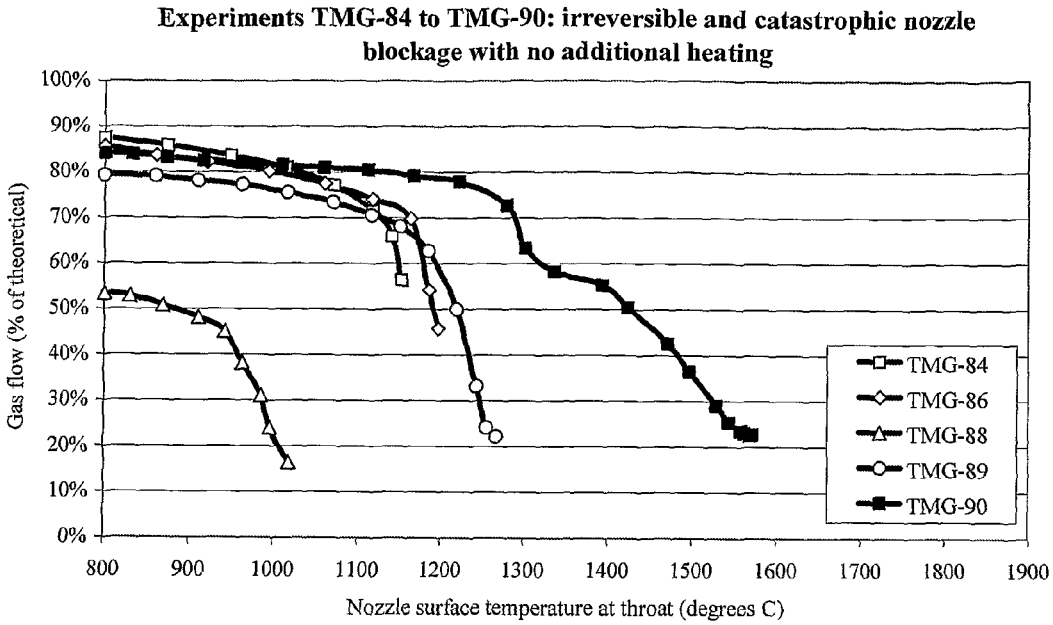
FIG. 12 shows gas flow data for experiments TMG-84, 85, and 88-89. The absence of additional nozzle heating resulted in catastrophic and irreversible nozzle blockage, and the experiments were forced to terminate early.

As shown in FIG. 12, the experiments conducted with no additional heating of the nozzle surface resulted in irrecoverable blockage, demonstrated by the drop in gas flow rate through the nozzle. The gas flow rate is directly proportional to the available cross-sectional area of the throat; as the flow is constricted sonic flow cannot be maintained.

Figure 13:
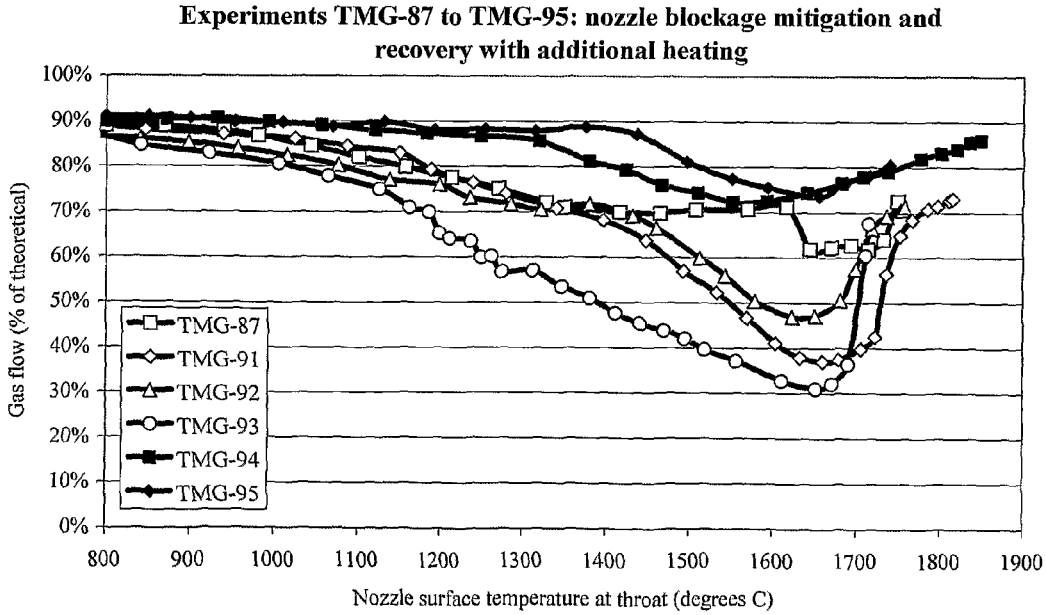
FIG. 13 shows gas flow data for experiments TMG-87 and 91-95. Additional direct nozzle heating was provided, and the chart shows that reliable operation can be achieved by maintaining the throat temperature above 1600° C.

FIG. 13 illustrates the improvement achieved by heating the nozzle surface further. While some early constriction is evident in the earlier tests, additional heating results in the maintenance of the integrity of the gas flow path and continued safe operation of the nozzle. The critical surface temperature of the nozzle throat is around 1600 to 1700° C.

In another embodiment of the present invention the momentum of the gas stream exiting the nozzle may be used for energy regeneration. Such energy may be recovered as electrical or thermal energy. In the latter case thermal energy may be re-used directly in the process of the invention, for pre-heating the reactants or providing additional control over the nozzle temperature.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

We claim:

1. A process for the production of a metal which comprises:
carbothermal reduction of a metal oxide corresponding to the metal to produce a mixed gas stream comprising the metal and carbon monoxide;
maintaining the mixed gas stream at a suitably elevated temperature to prevent reformation of the metal oxide;
ejecting the mixed gas stream through a convergent-divergent nozzle of a reactor in order to cool the mixed gas stream instantaneously to a temperature at which reformation of the metal oxide cannot take place; and
separating and collecting the metal,
wherein the convergent-divergent nozzle of the reactor is heated by induction coils that are arranged around the nozzle, such that surfaces of the nozzle in contact with the mixed gas stream are maintained at a temperature sufficient to prevent deposition on the said surfaces of products from the gas stream.

2. The process of claim 1, wherein on start-up, the nozzle temperature is elevated by heating prior to any gas being allowed to flow through the nozzle.

3. The process of claim 1, wherein a requisite temperature profile for the nozzle is predetermined based on a composition of a starting material to be reduced and on a gaseous species that will be flowing through the nozzle at any point in time.

4. The process of claim 1, wherein the metal is magnesium.

5. A reactor for the production of a metal by a process comprising:
(a) carbothermal reduction of a metal oxide corresponding to the metal to produce a mixed gas stream comprising the metal and carbon monoxide;
(b) maintaining the mixed gas stream at a suitably elevated temperature to prevent reformation of the metal oxide;
(c) ejecting the mixed gas stream through a convergent-divergent nozzle of the reactor in order to cool the mixed gas stream instantaneously to a temperature at which reformation of the metal oxide cannot take place; and
(d) separating and collecting the metal,
wherein the reactor comprises a convergent-divergent nozzle configured to be heated by induction coils that are arranged around the nozzle, such that surfaces of the nozzle in contact with the mixed gas stream are maintained at a temperature sufficient to prevent deposition on the said surfaces of products from the mixed gas stream.

6. A reactor for the production of a metal, the reactor comprising:

a convergent-divergent nozzle configured to eject a mixed gas stream; and induction coils that are arranged around the nozzle and configured to heat the convergent-divergent nozzle such that surfaces of the nozzle in contact with the mixed gas stream are maintained at a temperature sufficient to prevent deposition on the said surfaces of products from the mixed gas stream.

* * * * *